US007459011B2

(12) United States Patent
Cadours et al.

(10) Patent No.: US 7,459,011 B2
(45) Date of Patent: Dec. 2, 2008

(54) METHOD FOR PROCESSING A NATURAL GAS WITH EXTRACTION OF THE SOLVENT CONTAINED IN THE ACID GASES

(75) Inventors: Renaud Cadours, Francheville (FR); Fabrice Lecomte, Paris (FR); Lionel Magna, Lyons (FR); Cécile Barrere-Tricca, Soucieu en Jarrest (FR)

(73) Assignee: Institut Francais du Petrole, Rueil Malmaison Cedex (FR)

( * ) Notice: Subject to any disclaimer, the term of this patent is extended or adjusted under 35 U.S.C. 154(b) by 636 days.

(21) Appl. No.: 11/057,011

(22) Filed: Feb. 14, 2005

(65) Prior Publication Data

US 2005/0183337 A1 Aug. 25, 2005

(30) Foreign Application Priority Data

Feb. 13, 2004 (FR) ..... 04 01503

(51) Int. Cl.
*B01D 53/14* (2006.01)

(52) U.S. Cl. ..... 95/178; 95/179; 95/181; 95/183; 95/235; 95/236

(58) Field of Classification Search ..... 95/181, 95/183, 235, 236, 178, 179; 585/833, 809, 585/810, 860, 864; 556/174, 178, 180, 186
See application file for complete search history.

(56) References Cited

U.S. PATENT DOCUMENTS 3,767,766 A * 10/1973 Tjoa ..... 423/220
4,460,385 A * 7/1984 Pan et al. ..... 95/162
6,339,182 B1 * 1/2002 Munson et al. ..... 585/809
7,053,232 B2 * 5/2006 Moulton ..... 556/174
7,276,153 B2 * 10/2007 Wagner et al. ..... 208/240
7,304,200 B2 * 12/2007 Roettger et al. ..... 585/833
2002/0104438 A1 8/2002 Cadours et al.
2002/0189444 A1 * 12/2002 Brennecke et al. ..... 95/45
2005/0090704 A1 * 4/2005 Roettger et al. ..... 585/860

FOREIGN PATENT DOCUMENTS

WO WO 03/086605 A2 10/2003
WO WO 03/086605 A3 10/2003

* cited by examiner

*Primary Examiner*—Duane S Smith
*Assistant Examiner*—Ives Wu
(74) *Attorney, Agent, or Firm*—Antonelli, Terry, Stout & Kraus, LLP.

(57) ABSTRACT

The natural gas arriving through pipe 1 is deacidified by being brought into contact with a solvent in zone C. The solvent charged with acid compounds is regenerated in zone R. The acid gases, released into pipe 5 upon regeneration, include a quantity of solvent. The method enables the solvent contained in the acid gases to be extracted. In zone ZA, the acid gases are brought into contact with a non-aqueous ionic liquid whose general formula is $Q^+ A^-$, where $Q^+$ designates an ammonium, phosphonium, and/or sulfonium cation, and $A^-$ designates an anion able to form a liquid salt. The solvent is removed from the acid gases evacuated through pipe 6. The ionic liquid charged with solvent is regenerated by heating in an evaporator DE. The ionic liquid regenerated is recycled through pipes 8 and 9 to zone ZA. The solvent is evacuated through pipe 13.

10 Claims, 3 Drawing Sheets

Figure 1A:
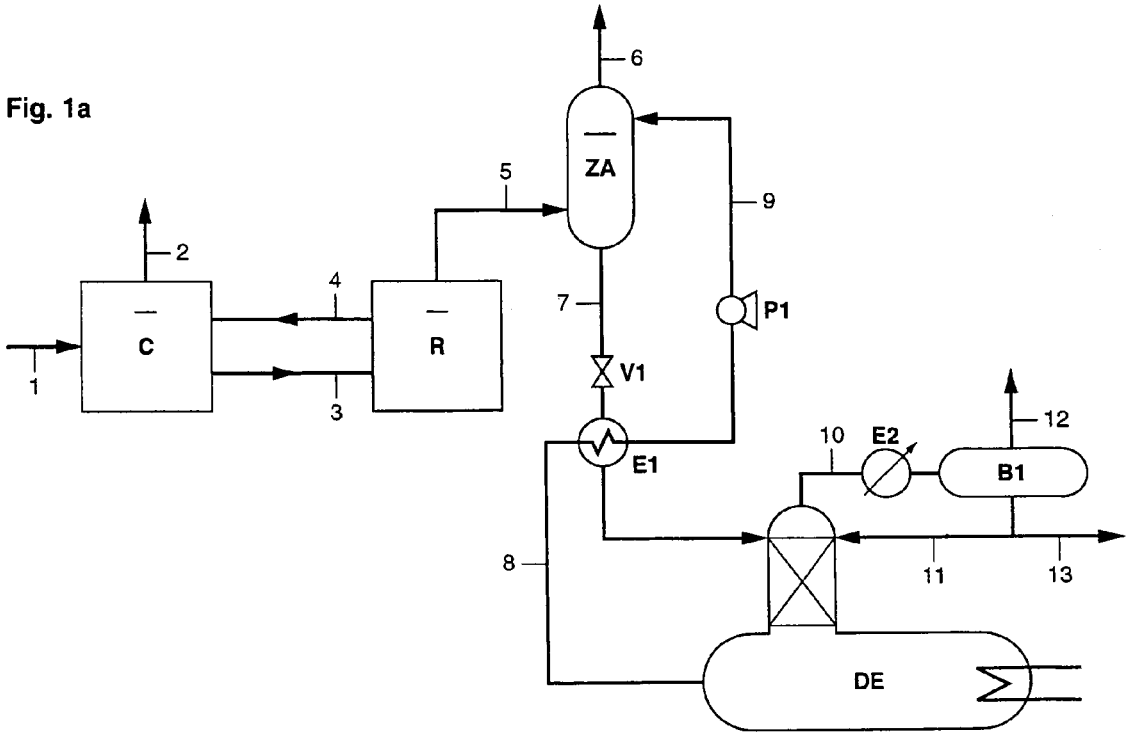

METHOD FOR PROCESSING A NATURAL GAS WITH EXTRACTION OF THE SOLVENT CONTAINED IN THE ACID GASES

The present invention relates to the area of natural gas processing. Specifically, the goal of the present invention is to extract the solvent contained in the acid gases.

In general, deacidification of a natural gas is accomplished by absorption of acid compounds such as carbon dioxide ($CO_2$), sulfur dioxide ($H_2S$), mercaptans, and carbonyl sulfide monoxide (COS) by a solvent.

French Patent 2,636,857 proposes absorbing the acid gases with a solvent containing 50 to 100 wt. % methanol at a low temperature, between −30° C. and 0° C. French Patent 2,743,083 performs the deacidification operation using a solvent composed of water, alkanolamine, and methanol. Absorption of the acid compounds is effected at temperatures between 40° C. and 80° C. In all cases, the solvent is regenerated by expansion and/or by temperature elevation, which can be done in a distillation column. The gaseous effluent containing the acid compounds that is rejected upon regeneration has the drawback of also containing a fraction of solvent. Solvent losses are even greater in the case of high-temperature regeneration. These solvent losses can have a non-negligible financial and ecological cost.

Current techniques for limiting methanol losses consist of condensing the gaseous effluent containing the acid compounds and solvent so as to recover the solvent in liquid form, and evacuating the acid compounds in the gaseous form. An alternative consists of recovering the condensed solvent formed in the gaseous effluent recompression system, in the case of reinjection into a well. The main flaw in these technologies is the partial dissolution of the acid compounds in the condensed solvent. The condensates containing solvent and acid compounds—up to 50 mol. % in the most unfavorable cases—have to be reprocessed to recover the solvent. Possible solutions are sending the condensates back into the process, for example at the bottom of the column in which the acid compounds are absorbed by the solvent, in intermediate solvent regeneration flash drums, or in the distillation regeneration column. The disadvantages of recovering and recycling the solvent are essentially the number of frigories (cold units) required to condense the solvent, the quantity of acid compounds entrained, and hence the impact of recycling the solvent into the process.

The present invention proposes a different solution for extracting the solvent contained in effluents having acid compounds, said effluents being released when the solvent employed in natural-gas processing is regenerated.

In general, the invention relates to a method for processing a natural gas containing at least one of the following acid compounds: hydrogen sulfide, carbon dioxide, mercaptans, and carbonyl sulfide, where the following steps are taken:

a) the natural gas is brought into contact with a solvent that takes up the acid compounds so as to obtain a purified gas and a solvent charged with acid compounds, b) the solvent charged with acid compounds is regenerated so as to obtain a regenerated solvent and release a gaseous effluent comprising acid compounds and a fraction of solvent, c) the gaseous effluent is brought into contact with a non-aqueous ionic liquid so as to obtain a gas phase containing acid compounds and an ionic liquid charged with solvent, the general formula of the ionic liquid being $Q^+ A^-$, where $Q^+$ designates an ammonium, phosphonium, and/or sulfonium cation, and $A^-$ designates an anion able to form a liquid salt, d) the ionic liquid charged with solvent is regenerated to separate the solvent and recover a solvent-impoverished ionic liquid.

According to the invention, in step d) the ionic liquid can be heated to evaporate the solvent and recover a solvent-impoverished ionic liquid.

The solvent evaporated in step d) can be condensed and, in step a), the natural gas can also be brought into contact with some of the condensed solvent.

The solvent evaporated in step d) can be condensed and, in step b), some of the condensed solvent can also be regenerated.

In step b), regeneration can take place by expansion and/or by temperature elevation.

Before step a), the natural gas can be placed inc contact with a solution containing methanol.

Before step c), the gaseous effluent obtained in step b) is cooled to condense some of the solvent.

The solvent can comprise at least one compound chosen from the glycols, ethers, glycol ethers, alcohols, sulfolane, N-methylpyrrolidone, propylene carbonate, ionic liquids, amines, alkanolamines, amino acids, amides, ureas, phosphates, carbonates, and alkaline metal borates.

The $A^-$ anion can be chosen from groups comprising the following halide ions: nitrate, sulfate, phosphate, acetates, halogen acetate, tetrafluoroborate, tetrachoroborate, hexafluorophosphate, hexafluoroantimonate, fluorosulfonate, alkyl sulfonates, perfluoroalkyl sulfonates, bis(perfluoroalkyl sulfonyl) amides, tris-trifluoromethanesulfonyl methylide with formula $(C(CF_3SO_2)_3^-$, alkyl sulfates, arene sulfates, arene sulfonates, tetraalkyl borates, tetraphenyl borate, and tetraphenyl borates whose aromatic rings are substituted.

The $Q^+$ cation can have one of the following general formulas $[NR^1R^2R^3R^4]^+$, $[PR^1R^2R^3R^4]^+$, $[R^1R^2N{=}CR^3R^4]^+$, and $[R^1R^2P{=}CR^3R^4]^+$ where $R^1$, $R^2$, $R^3$, and $R^4$ which are identical or different, represent hydrogen or hydrocarbyl residues with 1 to 30 carbon atoms, except for the $NH_4^+$ cation for $[NR^1R^2R^3R^4]^+$.

The $Q^+$ cation can also be derived from the nitrogen-containing and/or phosphorus-containing heterocycle having 1, 2, or 3 nitrogen and/or phosphorus atoms, the heterocycle being comprised of 4 to 10 carbon atoms.

The $Q^+$ cation can also have one of the following general formulas: $R^1R^2N^+{=}CR^3{-}R^5{-}R^3C{=}N^+R^1R^2$ and $R^1R^2P^+{=}CR^3{-}R^5{-}R^3C{=}P^+R^1R^2$ where $R^1$, $R^2$, and $R^3$ represent hydrogen or a hydrocarbyl residue with 1 to 30 carbon atoms and where $R^5$ represents an alkylene or phenylene residue.

The $Q^+$ cation can be chosen from the group including N-butylpyridinium, N-ethylpyridinium, pyridinium, 1-methyl-3-ethyl-imidazolium, 1-methyl-3-butyl-imidazolium, 1-methyl-3-hexyl-imidazolium, 1,2-dimethyl-3-butyl-imidazolium, diethyl-pyrazolium, N-butyl-N-methylpyrrolidinium, trimethylphenylammonium, tetrabutylphosphonium, and tributyltetradecylphosphonium.

The $Q^+$ cation can have the general formula $[SR^1R^2R^3]+$ where $R^1$, $R^2$, and $R^3$, which are identical or different, each represent a hydrocarbyl residue with 1 to 12 carbon atoms.

The ionic liquid can be chosen from the group comprising N-butyl-pyridinium hexafluorophosphate, N-ethyl-pyridinium tetrafluoroborate, pyridinium fluorosulfonate, 1-methyl-3-butyl-imidazolium tetrafluoroborate, 1-methyl-3-butyl-imidazolium bis-trifluoromethanesulfonyl amide, triethylsulfonium bis-trifluoromethanesulfonyl amide, 1-methyl-3-butyl-imidazolium hexafluoroantimonate, 1-methyl-3-butyl-imidazolium hexafluorophosphate, 1-methyl-3-butyl-imidazolium trifluoroacetate, 1-methyl-3-butyl-imidazolium trifluoromethylsulfonate, 1-methyl-3-butylimidazolium bis(trifluoromethylsulfonyl) amide, trimethylphenylammonium hexafluorophosphate, and tetrabutylphosphonium tetrafluoroborate.

Advantageously, the method according to the invention enables the solvent to be recovered at a high purity level—a level that can be compatible with recycling to the process.

Figure 1B:
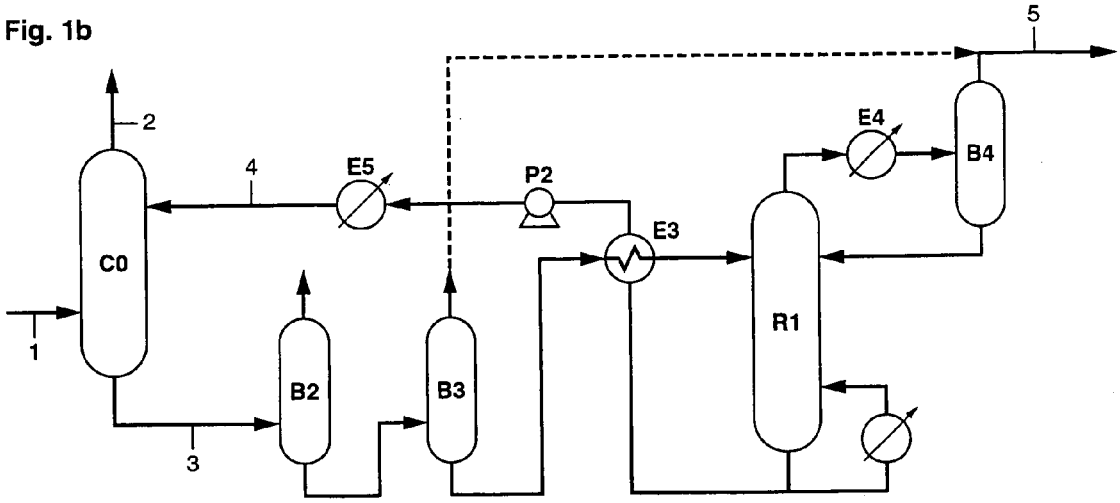
Figure 1C:
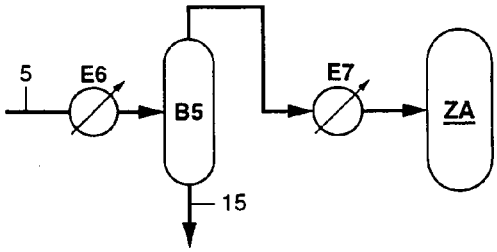
Figure 2:
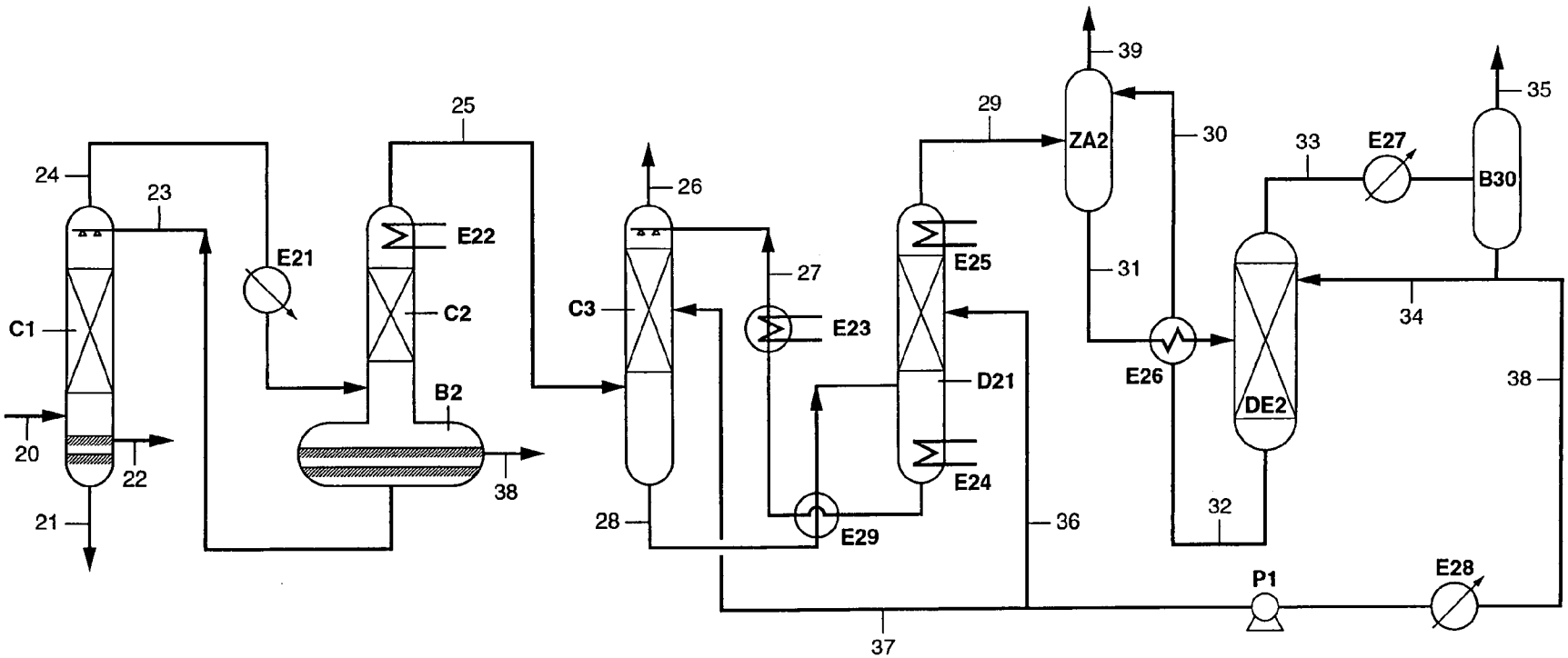
Figure 3:
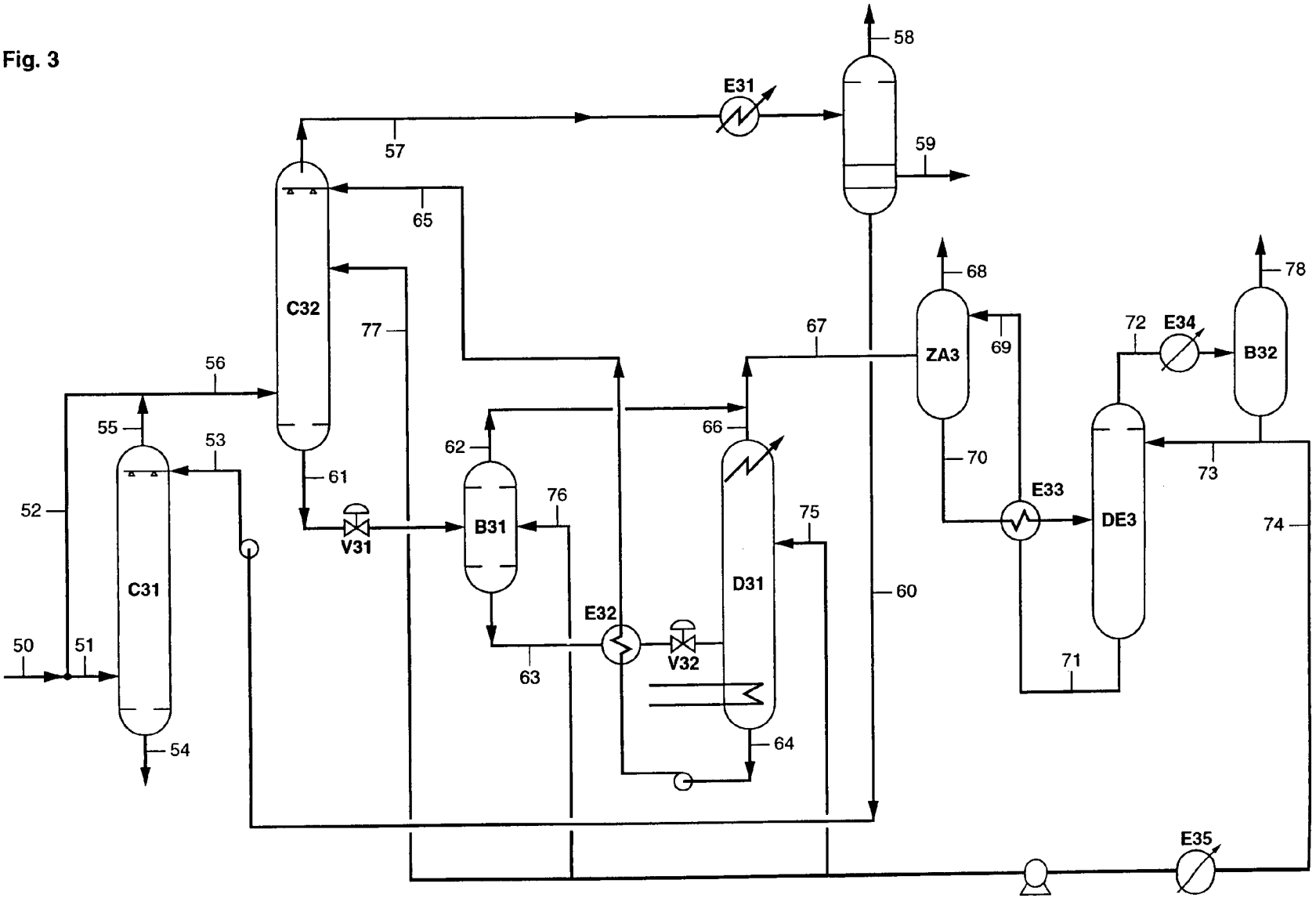

Other features and advantages of the invention will be better understood and appear clearly when reading the description hereinbelow with reference to the drawings:

FIGS. 1A and 1B show the method according to the invention schematically, FIG. 1C shows an improvement of the method described in FIG. 1A, FIGS. 2 and 3 show two embodiments of the invention.

In FIG. 1A, the natural gas to be processed arrives through pipe 1. The natural gas contains hydrocarbons, for example in proportions of between 50% and 90%, as well as acid compounds such as carbon dioxide ($CO_2$), hydrogen sulfide ($H_2S$), mercaptans, and carbonyl sulfide (COS), for example in proportions of between a few ppm and 50%.

This natural gas is introduced into the contacting zone C where it is brought into contact with a solvent arriving through pipe 4. In zone C, the solvent absorbs the acid compounds contained in the natural gas.

The solvents used in the present invention are absorption solutions comprising one or more organic solvents and/or one or more compounds having the ability to react reversibly with the acid gases ($CO_2$, $H_2S$, mercaptans, and COS) contained in the natural gas. The groups reacting with the acid gases can also be grafted onto the solvent or solvents. The solution used can contain water. The solvents can be glycols, glycol ethers, alcohols, sulfolane, N-methylpyrrolidone, propylene carbonate, or ionic liquids. The reactive compounds can be amines (primary, secondary, tertiary, cyclic or noncyclic, aromatic or nonaromatic), alkanolamines, amino acids, amides, ureas, phosphates, carbonates, or alkaline metal borates. The solution can also contain anticorrosion and/or antifoaming additives. The vapor pressure of the solution at 100° C. can advantageously be greater than 0.1 MPa, preferably greater than 0.2 MPa, and more preferably greater than 0.3 MPa. The absorption efficiency by the solvent increases as the molecules to be extracted have greater polarity or a higher dielectric constant.

The purified gas, i.e. impoverished in acid compounds, is evacuated from zone C by pipe 2. The solvent charged with acid compounds is evacuated from zone C by pipe 3, then introduced into regeneration zone R. Zone R enables the acid compounds to be separated from the solvent.

Zone R can consist of a succession of solvent expansions and/or temperature rises, for example by distillation, of the solvent. The expansion and temperature rise allow the acid compounds absorbed by the solvent to be released in the form of a gaseous effluent. Upon regeneration, a quantity of solvent is also vaporized and entrained with the acid compounds. Thus, the gaseous effluent evacuated from zone R by pipe 5 has not only acid compounds, in a proportion that may be between 70% and 99%, but also solvent in a proportion that may be between a few ppm and 30%. Moreover, the gaseous effluent can include hydrocarbons co-absorbed by the solvent in zone C, and possibly water as well. The regenerated solvent, i.e. solvent impoverished in acid compounds, obtained after expansion and/or distillation, is evacuated from zone R by pipe 4, and can be recycled to zone C.

The gaseous effluent leaving regeneration zone R is introduced into absorption zone ZA where it is brought into contact with a non-aqueous ionic liquid arriving through pipe 9. In zone ZA, the solvent contained in the gaseous effluent arriving through pipe 5 is absorbed by the ionic liquid. The solvent-impoverished gaseous effluent, i.e. solvent containing essentially acid compounds, is evacuated from zone ZA by pipe 6. The ionic liquid charged with solvent is evacuated from zone ZA by pipe 7. Contacting may be effected under pressure, for example between 0.1 MPa and 2 MPa, and at a temperature of between 20° C. and 100° C., preferably between 40° C. and 90° C.

The contacting in zone ZA can be accomplished in one or more co-current or counter-current washing columns, for example in plate columns of the perforated, valved, and/or cap type, or packed towers with bulk or structured packing. It is also possible to use contactors to effect the contact. The contactors can be of the static or the dynamic type, followed by decanting zones. A membrane contactor can also be used, in which the gaseous effluents flow on one side of a membrane, the ionic liquid flows on the other side of the membrane, and the material exchanges take place through the membrane.

Bearing in mind that the solvent arriving in regeneration zone R may be charged with water, a quantity of water contained in the gaseous effluent to be treated is co-absorbed by the ionic liquid in zone ZA. In the same way, a quantity of acid compounds, particularly $CO_2$, can be co-absorbed by the ionic liquid in zone ZA. By adapting zone ZA to the feedstock to be treated, it is possible be selective and thus ensure that the solvent is captured while at the same time co-absorption of acid compounds is minimized.

The non-aqueous ionic liquid used in the present invention is chosen from the group formed by liquid salts with the general formula $Q^+ A^-$, where $Q^+$ represents an ammonium, phosphonium, and/or sulfonium, and $A^-$ represents any organic or inorganic anion able to form a liquid salt at low temperature, namely below 100° C. and advantageously a maximum of 85° C., and preferably below 50° C.

In the non-aqueous ionic liquid with the formula $Q^+ A^-$, the $A^-$ anions are preferably chosen from the following halide anions: nitrate, sulfate, phosphate, acetates, halogen acetate, tetrafluoroborate, tetrachloroborate, hexafluorophosphate, hexafluoroantimonate, fluorosulfonate, alkyl sulfonates (for example methyl sulfonate), perfluoroalkyl sulfonates (for example trifluoromethyl sulfonate), bis(perfluoroalkyl sulfonyl) amides (for example bis-trifluoromethane sulfonyl amide with formula $N(CF_3SO_2)_2^-$), tris-trifluoromethanesulfonyl methylide with formula $(C(CF_3SO_2)_3^-$, arene sulfonates, possibly substituted by halogen or halogen alkyl groups, as well as the tetraphenylborate anion and tetraphenylborate anions whose aromatic rings are substituted.

The $Q^+$ cations are preferably chosen from the phosphonium, ammonium, and/or sulfonium group.

The quaternary ammonium and/or phosphonium $Q^+$ cations preferably have one of the general formulas $[NR^1R^2R^3R^4]^+$ and $[PR^1R^2R^3R^4]^+$, or one of the general formulas $[R^1R^2N{=}CR^3R^4]^+$, and $[R^1R^2P{=}CR^3R^4]^+$ wherein $R^1$, $R^2$, $R^3$, and $R^4$ which are identical or different, each represent hydrogen (with the exception of the $NH_4^+$ cation for $[NR^1R^2R^3R^4]^+$), preferably a single substituent representing hydrogen, or hydrocarbyl residues with 1 to 30 carbon atoms, for example alkyl groups, saturated or nonsaturated, cycloalkyl, or aromatic, aryl or aralkyl, possibly substituted, with 1 to 30 carbon atoms.

The ammonium and/or phosphonium cations can also be derived from nitrogen-containing and/or phosphorus-containing heterocycles having 1, 2, or 3 nitrogen and/or phosphorus atoms, with the general formulas:

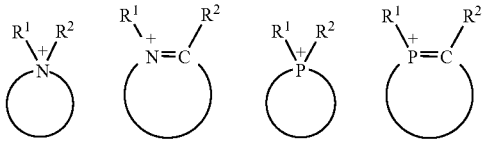

wherein the cycles are comprised of 4 to 10 atoms, preferably 5 to 6 atoms, and $R^1$ and $R^2$ are defined as above.

The ammonium or phosphonium cation can also have one of the following general formulas:

$$R^1R^2N^+{=}CR^3{-}R^5{-}R^3C{=}N^+R^1R^2 \text{ and } R^1R^2P^+{=}CR^3R^5{-}R^3C{=}P^+R^1R^2$$

wherein $R^1$, $R^2$, and $R^3$, which are identical or different, are defined as above and $R^5$ represents an alkylene or phenyl group. Of the $R^1$, $R^2$, $R^3$, and $R^4$ groups, the methyl, ethyl, propyl, isopropyl, secondary butyl, tertiary butyl, butyl, amyl, phenyl, or benzyl radicals may be mentioned; $R^5$ can be a methylene, ethylene, propylene, or phenylene group.

The ammonium and/or phosphonium cation $Q^+$ is preferably chosen from the group formed by N-butylpyridinium, N-ethylpyridinium, pyridinium, 1-methyl-3-ethyl-imidazolium, 1-methyl-3-butyl-imidazolium, 1-methyl-3-hexyl-imidazolium, 1,2-dimethyl-3-butyl-imidazolium, diethyl-pyrazolium, N-butyl-N-methylpyrrolidinium, trimethylphenylammonium, tetrabutylphosphonium, and tributyltetradecylphosphonium.

The sulfonium cations $Q^+$ can have the general formula $[SR^1R^2R^3]^+$, where $R^1$, $R^2$, and $R^3$, which are identical or different, each represent a hydrocarbyl residue with 1 to 12 carbon atoms, for example an alkyl group, saturated or non-saturated, or cycloalkyl or aromatic, aryl, alkaryl, or aralkyl group having 1 to 12 carbon atoms.

The following salts usable according to the invention may be cited as examples: N-butyl-pyridinium hexafluorophosphate, N-ethyl-pyridinium tetrafluoroborate, pyridinium fluorosulfonate, 1-methyl-3-butyl-imidazolium tetrafluoroborate, 1-methyl-3-butyl-imidazolium bis-trifluoromethanesulfonyl amide, triethylsulfonium bis-trifluoromethanesulfonyl amide, 1-methyl-3-butyl-imidazolium hexafluoroantimonate, 1-methyl-3-butyl-imidazolium hexafluorophosphate, 1-methyl-3-butyl-imidazolium trifluoroacetate, 1-methyl-3-butyl-imidazolium trifluoromethylsulfonate, 1-methyl-3-butyl-imidazolium bis(trifluoromethylsulfonyl) amide, trimethylphenylammonium hexafluorophosphate, and tetrabutylphosphonium tetrafluoroborate. These salts can be used singly or mixed.

The ionic liquid circulating in pipe 7 is regenerated by separating the ionic liquid from the solvent. Various techniques can be used to effect this regeneration.

According to a first technique, the ionic liquid circulating in pipe 7 is regenerated by precipitating the ionic liquid by cooling and/or pressure drop, then separating the liquid solvent from the precipitated ionic liquid.

According to a second technique, the ionic liquid circulating in pipe 7 is regenerated by a technique usually known as stripping. The solvent-charged ionic liquid is brought into contact with a fluid such that the fluid entrains the solvent. For example, the solvent-charged ionic liquid is brought into contact with the natural gas before processing. Thus, the natural gas entrains the solvent and the ionic liquid is solvent-impoverished.

According to a third technique illustrated in FIG. 1A, recovery of the solvent absorbed by the ionic liquid circulating in pipe 7 is accomplished by evaporating the solvent. The solvent-charged ionic liquid can be expanded by expansion device VI, possibly introduced into a separating drum to release the components vaporized upon expansion, and can then be heated in the heat exchanger E1. Finally, the ionic liquid is introduced into evaporation device DE. Evaporator DE enables the solvent to be separated from the ionic liquid. In evaporator DE, the solvent-charged ionic liquid is heated in a reboiler to a sufficient temperature to evaporate the solvent. The ionic liquid can be introduced into evaporator DE such that it comes in contact with the evaporated solvent. The thermodynamic conditions (pressure and temperature) of evaporation are to be determined by the individual skilled in the art according to the financial considerations specific to each case. For example, evaporation can be carried out at a pressure of between 0.01 MPa and 3 MPa, and at the corresponding temperature for solvent evaporation. When the solvent is a glycol such as MEG or DEG, the temperature can be between 135° C. and 180° C. for a pressure of between 0.005 MPa and 0.1 MPa. When the solvent is methanol, the evaporation temperature can be between 10° C. and 140° VC. for a pressure between 0.01 MPa and 1 MPa. The heat stability of the ionic liquids allows a very broad temperature range to be used. The evaporated solvent is evacuated from evaporator DE through pipe 10. The gas circulating in pipe 10 can be partially condensed by cooling in the heat exchanger E2, then introduced into drum B1. The elements that are not condensed are evacuated from drum B1 through pipe 12. The condensates obtained at the bottom of drum B1 constitute the solvent extracted from the gaseous effluent evacuated from the regeneration zone R through pipe 5. Some of the solvent extracted can be refluxed through pipe 11 into evaporator DE. Another portion of the extracted solvent is evacuated through pipe 13.

The regenerated ionic liquid, i.e. liquid containing little or no solvent, is evacuated as a liquid from evaporator DE through pipe 8. The regenerated ionic liquid can be cooled in heat exchanger E1, pumped by pump P1, then introduced through pipe 9 into absorption zone ZA.

For example, evaporator DE can be a distillation column with three to ten plates, plus a boiler.

The pressure and temperature conditions under which the evaporation step takes place in evaporator DE can be selected so as to enable any water traces, co-absorbed by the liquid in zone ZA, to remain in the regenerated ionic liquid sent to zone ZA.

The solvent recovered through pipe 13 can be recycled. For example, this solvent is recycled in regeneration zone R by being injected into flash drums or used as reflux in a distillation column. The solvent recovered through pipe 13 can also be injected into capture zone C by being injected into the natural gas deacidification column.

FIG. 1B shows further details of the contacting zone C and regeneration zone R in FIG. 1A. The reference numerals in FIG. 1B that are identical to those in FIG. 1A designate the same elements.

In FIG. 1B, the natural gas arriving through pipe 1 is introduced into contacting column C0, in which it contacts the solvent arriving through pipe 4. For example, in C0, the temperature can vary between 40° C. and 90° C. if the solvent is of the chemical type or −30° C. and 40° C. if the solvent is of the physical type, and the pressure can vary between 6 MPa and 10 MPa.

The solvent charged with acid compounds is evacuated from C0 through pipe 3, then expanded. For example, the solvent charged with acid compounds is sequentially expanded in drum B2 at a pressure of 1.5 MPa to 4 MPa, then in drum B3 at a pressure between 0.2 MPa and 2 MPa.

The expanded solvent is heated in heat exchanger E3, then introduced into regeneration column R1. In general, column R1 is a distillation column. The reboiler sets the temperature at the bottom of the column. For a solvent including amines such as MEA, DEA, or MDEA, the temperature at the bottom of column R1 can be between 100° C. and 140° C. For a solvent including an alcohol, the temperature at the bottom of column R1 can be greater than 140° C. The gaseous effluent evacuated at the column head is partially condensed by exchanger E4, then introduced into drum B4. The liquid collected at the bottom of drum B4 is refluxed at the head of column R1. The gas evacuated at the head of drum B4, possibly mixed with the gas released upon expansion in drum B3, through pipe 5, is processed in the same way as the gaseous effluent circulated through pipe 5 in FIG. 1A.

The regenerated solvent obtained at the bottom of column R1 is cooled in heat exchanger E3, pumped by pump P2, possibly subcooled by heat exchanger E5, then introduced by pipe 4 into column C0.

The liquid evacuated by pipe 13 in the method shown schematically in FIG. 1 can be introduced either into regeneration column R1, or into drum B3, or into absorption column C0.

FIG. 1C shows an improvement on the method described in relation to FIG. 1A. The reference numerals of FIG. 1C identical to those of FIG. 1A designate the same elements.

The gaseous effluent circulating in pipe 5 includes, in particular, solvent and acid compounds. This gaseous effluent is partially condensed by cooling in heat exchanger E6, for example at a temperature between −40° C. and 0° C., then introduced into separating drum B5. The condensates consisting essentially of solvent are evacuated from drum B5 through pipe 15. The gas phase obtained at the head of drum B5 is heated in heat exchanger E7, then introduced into absorption zone ZA.

The improvement described in relation to FIG. 1C allows some of the solvent contained in the effluent circulating in pipe 5 to be extracted by cooling, thus reducing the flow of ionic liquid necessary to capture the solvent in zone ZA.

The following numerical example illustrates the method according to the invention described with reference to FIG. 1A.

The natural gas arriving through pipe 1 is deacidified by being brought into contact with a solvent containing 50 wt. % water, 30 wt. % diethanolamine, and 20 wt. % methanol. The acid gaseous effluent obtained after solvent regeneration is at 45° C. and 0.2 MPa. The gaseous effluent circulates in pipe 5 at a rate of 4000 kmol/h, and contains 20 vol. % methanol, 0.01 vol. % water, 66 vol. % $H_2S$, 10 vol. % $CO_2$, and 4 vol. % hydrocarbons.

It is brought into contact with an ionic liquid, 1-butyl-3-methylimidazolium bis(trifluoromethylsulfonyl)amide (BMIM) (TF2N) in order to recover the methanol contained in the gaseous acid effluent.

An ionic liquid flowrate of 30 $m^3$/h in ZA allows 95% of the methanol contained in the gas to be recovered, using a gas-liquid contactor developing an efficiency equivalent to two theoretical stages. The use of 60 $m^3$/h of solvent reduces the methanol level in the treated gas by at least 10 ppm, considering at least four theoretical efficiency stages for the gas-liquid contactor. In view of the disproportion between the water and methanol levels, the final treated-gas level is less than 10 ppm. When the gas is brought into contact with the ionic liquid in ZA, a fraction of the acid gases is absorbed. This fraction remains less than 10% of the quantity of acid compounds contained in the gas to be treated.

The washing efficiency by the ionic liquid is conditional on its regeneration level. Regeneration is preferably effected at a low pressure, between 0.02 MPa and 1 MPa, at a temperature between 60° C. and 150° C. in order to favor optimum evaporation of the methanol and water absorbed by the ionic liquid and thus ensure a methanol and water level of less than 50 ppm mol in the ionic liquid. Upon regeneration, acid gases are also released.

The following numerical example illustrates the method according to the invention, described with reference to FIG. 1C.

The natural gas arriving through pipe 1 is deacidified by being brought into contact with a solvent containing 50 wt. % water, 30 wt. % diethanolamine, and 20 wt. % methanol. The acid gaseous effluent obtained after regeneration of the solvent is 45° C. and 0.2 MPa. The gaseous effluent circulates in pipe 5 at a rate of 4000 kmol/h, and contains 20 vol. % methanol, 0.01 vol. % water, 66 vol. % $H_2S$, 10 vol. % $CO_2$, and 4 vol. % hydrocarbons.

The gaseous effluent circulating in pipe 5 is cooled in exchange E6 at −30° C. At the head of drum B5, a gas phase is obtained at a rate of 2900 kmol/h, containing 0.2 vol. % methanol, 82 vol. % $H_2S$, 14 vol. % $CO_2$, and less than 4% hydrocarbons. The water content of this gas phase is between 10 and 50 ppm. After being heated to 50° C. in exchanger E7, this gas phase is washed by an ionic liquid in zone ZA. The use of 30 $m^3$/h (BMIM (TF2N) leads to 99% recovery of the methanol contained in this gas phase with a contactor developing an efficiency equivalent to three theoretical stages.

FIG. 2 shows the gas processing method disclosed by French Patent 2,636,857 in which the method according to the invention is applied to extract the solvent contained in the gaseous effluents rejected when the solvent is regenerated.

According to FIG. 2, the natural gas to be treated, containing methane, water, acid compounds, and at least one hydrocarbon condensable at atmospheric pressure and about 20° C., arrives through pipe 20. In contact zone C1, it is brought into contact with a solvent-water mixture introduced through pipe 23. The solvent can be as defined above. Preferably, the solvent can be chosen from the group comprising methanol, ethanol, methoxyethanol, propanol, methyl propyl ether, ethyl propyl ether, diprolyl ether, methyl tertiobyl ether, dimethoxymethane, and dimethoxyethane. A gas phase charged with solvent is evacuated through pipe 24 at the head of column C1. An aqueous phase is tapped off through pipe 21 at the bottom of column C1. If a hydrocarbon phase is condensed, it is separated by decanting and evacuated through pipe 22.

The gas phase circulating in pipe 24 is condensed, at least partially, in heat exchanger E21, then introduced into contact zone C2. The resulting gas phase is contacted in zone C2 with the downcoming condensate formed in contact with cooling circuit E22. Two phases separate in settling tank B2. These phases result from the condensations occurring in E21 and E22 and from the contact effected in C2. A hydrocarbon phase is evacuated through pipe 38. The aqueous phase formed essentially of water and solvent is sent through line 23 to zone C1.

The gas, impoverished of condensable hydrocarbons but still containing a noteworthy proportion of acid compounds, is sent through line 25 to contact zone C3 where it contacts a regenerated solvent phase arriving through line 27 in a counter-current fashion. Solvent may be introduced into zone C3 through pipe 37. The treated gas, i.e. impoverished of acid compounds, is evacuated through pipe 26.

The solvent phase charged with acid compounds is recovered at the bottom of zone C3 by pipe 28, may be expanded and heated in heat exchanger E29, and is then injected into distillation column D21 to effect separation between the acid compounds and the solvent. Solvent may be introduced into D21 through pipe 36. The reboiler E24 supplies heat for distillation. The regenerated solvent is tapped off from the bottom of column D21, cooled by exchanger E29, subcooled by exchanger E23, then introduced into column C3. The acid compounds as well as solvent are evacuated in the form of gaseous effluent from column D21 via pipe 29.

In contacting zone ZA2, the gaseous effluent circulating in pipe 29 is brought into contact with a non-aqueous ionic liquid as defined above which arrives through pipe 30. The acid compounds are evacuated by pipe 39 in the gaseous form. The solvent-charged ionic liquid is evacuated through pipe 31, heated by heat exchanger E26, then introduced into evaporator DE2. The regenerated ionic liquid obtained at the bottom of DE2 is cooled in heat exchanger E26, then introduced into zone ZA2 via pipe 30.

The solvent obtained at the head of DE2 is evacuated through pipe 33, partially condensed by heat exchanger E27, then introduced into drum B30. The non-condensed compounds are evacuated at the head of drum B30 through pipe 35. The condensates obtained at the bottom of drum B30 constitute the solvent extracted from the effluent available at the head of column D21. Some of the condensate is refluxed into column DE2 through pipe 34. Another portion of condensate is evacuated through pipe 38, cooled by heat exchanger E28, then pumped by pump P1. Next, the solvent can be recycled. For example, the solvent is introduced into distillation column D21 through pipe 36 and/or the solvent is introduced into the contacting zone C3 through pipe 37.

FIG. 3 shows the gas-processing method disclosed in French Patent 2,743,083 in which the method according to the invention is applied to extract the solvent contained in the gaseous effluent rejected when the solvent was regenerated.

In FIG. 3, the gas to be processed arrives through pipe 50. It contains, for example, methane, ethane, propane, and butane as well as heavier hydrocarbons, water, and acid compounds such as for example $H_2S$ and $CO_2$.

A fraction of this gas is sent through pipe 51 to contacting column C31 in which it is brought into contact with an aqueous solution of methanol arriving through pipe 53. At the bottom of column C31, an aqueous phase from which the methanol has been substantially removed is evacuated through pipe 54. At the head of column C31, a methanol-charged gas, mixed with a second fraction of gas to be treated arriving through pipe 52, is evacuated through pipe 55. This gas mixture is sent through pipe 56 to column C32 in which it is brought into contact with a solvent arriving through pipe 65 and, possibly, through pipe 77. The gas impoverished of acid compounds is evacuated from column C32 through pipe 57. The solvent charged with acid compounds is evacuated through pipe 61 at the bottom of column C32.

The solvent contains methanol, water, and a solvent heavier than methanol. The heavy solvent can be a polar solvent such as DMF, NMP, DMSO, sulfolane, propylene carbonate, promylene carbonate, an alcohol heavier than methanol, an ether, or a ketone. The heavy solvent can also be a chemical-type solvent such as an amine, for example monoethanolamine, diethanolamine, diglycolamine, diisopropanolamine, or methyldiethanolamine.

The solvent circulating in pipe 61 is expanded by valve V31, releasing a gas phase that has acid compounds and a fraction of solvent. The gas and liquid phases thus obtained are separated in drum B31. The gas phase is evacuated at the head of drum B31 through pipe 62. The liquid phase containing solvent charged with acid compounds is tapped off from the bottom of drum B31 through pipe 63, heated in heat exchanger E32, possibly expanded by valve V32, then introduced into distillation column D31. Solvent can also be introduced into the column through pipe 75. The regenerated solvent is recovered at the bottom of distillation column D31 through pipe 64, cooled in heat exchanger E32, and introduced into column C32 through pipe 65. The acid compounds separated from the solvent by distillation in column D31 are evacuated in the form of a gaseous effluent through pipe 66. In general, the gaseous effluent has a fraction of solvent.

The gaseous effluent arriving through pipe 66, and possibly the gas phase arriving through pipe 62, are introduced by pipe 67 into the contacting zone ZA3 to be brought into contact with a non-aqueous ionic liquid, as defined above, arriving through pipe 69. The acid compounds are evacuated through pipe 68 in gaseous form. The solvent-charged ionic liquid is evacuated by pipe 70, heated by heat exchanger E33, then introduced into evaporator DE3. DE3 can be a distillation column. The regenerated ionic liquid obtained at the bottom of DE3 is evacuated through pipe 71, cooled in exchanger E33, then introduced into zone ZA3 through pipe 69.

The solvent obtained at the head of DE3 is evacuated through pipe 72, partially condensed by heat exchanger E34, then introduced into drum B32. A gas phase can be evacuated at the head of drum B32 by pipe 78. The condensates obtained at the bottom of drum B32 constitute the solvent extracted from the effluent circulating in pipe 67. Some of the solvent is refluxed into column DE3 through pipe 73. Another portion of the solvent is evacuated by pipe 74, cooled by heat exchanger E35, then pumped. Next, the solvent can be recycled. For example, the solvent is introduced into distillation column D31 by pipe 75, into separating drum B31 through pipe 76, and/or into contacting column C32 through pipe 77.

The invention claimed is:

1. Method for processing a natural gas containing at least one of the following acid compounds: hydrogen sulfide, carbon dioxide, mercaptans, and carbonyl sulfide, where the following steps are taken:

a) the natural gas is brought into contact with a solvent that takes up the acid compounds so as to obtain a purified gas and a solvent charged with acid compounds, b) the solvent charged with acid compounds is regenerated so as to obtain a regenerated solvent and release a gaseous effluent containing acid compounds and a fraction of solvent, characterized in that the following steps are carried out:

c) the gaseous effluent is brought into contact with a non-aqueous ionic liquid so as to obtain a gas phase containing acid compounds and an ionic liquid charged with solvent, the general formula of the ionic liquid being $Q^+A^-$, where $Q^+$ designates an ammonium, phosphonium, and/or sulfonium cation, and $A^-$ designates an anion able to form a liquid salt, wherein the $Q^+$ cation has one of the following general formulas: $R^1R^2N^+{=}CR^3{-}R^5{-}R^3C{=}N^+R^1R^2$ and $R^1R^2P^+{=}CR^3{-}R^5{-}R^3C{=}P^+R^1R^2$ where $R^1$, $R^2$, and $R^3$ represent hydrogen or a hydrocarbyl with 1 to 30 carbon atoms and where $R^5$ represents an alkylene or phenylene residue, and d) the ionic liquid charged with solvent is regenerated to separate the solvent and recover a solvent-impoverished ionic liquid.

2. Method according to claim 1, wherein, in step d) the ionic liquid is heated to evaporate the solvent and recover a solvent-impoverished ionic liquid.

3. Method according to claim 2 wherein the solvent evaporated in step d) is condensed and wherein the natural gas is also brought into contact with some of the condensed solvent in step a).

4. Method according to claim 2 wherein the solvent evaporated in step d) is condensed to form condensed solvent and some of the condensed solvent is regenerated in step b).

5. Method according to claim 1 wherein, in step b), regeneration takes place by expansion and/or by temperature elevation.

6. Method according to claim 1 wherein, before step a), the natural gas is brought into contact with a solution containing methanol.

7. Method according to claim 1 wherein, before step c), the gaseous effluent obtained in step b) is cooled to condense some of the solvent.

8. Method according to claim 1 wherein, the solvent has at least one compound chosen from the glycols, ethers, glycol ethers, alcohols, sulfolane, N-methylpyrrolidone, propylene carbonate, ionic liquids, amines, alkanolamines, amino acids, amides, ureas, phosphates, carbonates, and alkaline metal borates.

9. Method according to claim 1 wherein the $A^-$ anion is chosen from groups comprising the following halide ions: nitrate, sulfate, phosphate, acetates, halogen acetates, tetrafluoroborate, tetrachloroborate, hexafluorophosphate, hexafluoroantimonate, fluorosulfonate, alkyl sulfonates, perfluoroalkyl sulfonates, bis(perfluoroalkyl sulfonyl) amides, tris-trifluoromethanesulfonyl methylide with formula $(C(CF_3SO_2)_3^-$, arene sulfonates, tetraphenyl borate, and tetraphenyl borates whose aromatic rings are substituted.

10. Method according to claim 1 wherein the ionic liquid is chosen from the group comprising N-butyl-pyridinium hexafluorophosphate, N-ethyl-pyridinium tetrafluoroborate, pyridinium fluorosulfonate, 1 -methyl-3-butyl-imidazolium tetrafluoroborate, 1 -methyl-3-butyl-imidazolium bis-trifluoromethanesulfonyl amide, triethylsulfonium bis-trifluoromethanesulfonyl amide, 1 -methyl-3-butyl-imidazolium hexafluoroantimonate, 1 -methyl-3-butyl-imidazol ium hexafluorophosphate, 1-methyl-3-butyl-imidazolium trifluoroacetate, 1 -methyl-3-butyl-imidazolium trifluoromethylsulfonate, 1 -methyl-3-butyl-imidazolium bis(trifluoromethylsulfonyl) amide, trimethylphenylammonium hexafluorophosphate, and tetrabutyl phosphon urn tetrafi uoroborate.

* * * * *